United States Patent [19]

Burt

[11] 4,087,061

[45] May 2, 1978

[54] WIDE ANGLE SEEKER

[75] Inventor: Warren T. Burt, China Lake, Calif.

[73] Assignee: The United States of America as represented by the Secretary of the Navy, Washington, D.C.

[21] Appl. No.: 251,486

[22] Filed: May 8, 1972

[51] Int. Cl.[2] ..... G02B 23/02

[52] U.S. Cl. ..... 244/3.16; 350/16; 356/248

[58] Field of Search ..... 244/3.16; 350/16; 356/148, 149, 248, 250

[56] References Cited

U.S. PATENT DOCUMENTS

| | | | |
|---|---|---|---|
| 2,873,381 | 2/1959 | Lauroesch | 244/3.16 |
| 3,100,264 | 8/1963 | Jaffe et al. | 250/226 X |
| 3,165,749 | 1/1965 | Cushner | 244/3.16 X |
| 3,293,437 | 12/1966 | Boydell | 244/3.16 X |
| 3,612,643 | 10/1971 | Weber | 350/16 X |
| 3,617,016 | 11/1971 | Bolsey | 244/3.16 |
| 3,698,790 | 10/1972 | Berry | 350/16 |

*Primary Examiner*—Harold Tudor
*Attorney, Agent, or Firm*—R. S. Sciascia; Roy Miller; Thomas W. Hennen

[57] ABSTRACT

A wide angle seeker for missile guidance systems and the like which utilizes a dual motion mirror in an optical transfer system to allow a missile sensor to be mounted in a stationary position in the missile body remote from the seeker.

2 Claims, 2 Drawing Figures

WIDE ANGLE SEEKER

BACKGROUND OF THE INVENTION

1. Field of the Invention

This invention relates to seekers for use in the guidance systems of guided missiles and the like. More particularly, this invention relates to seekers for use in conjunction with body mounted sensors.

2. Description of the Prior Art

A missile guidance system is a complex combination of components. Each component must function in order to make the system as a whole operate correctly. A seeker forms one group of components in a missile guidance system. A seeker is a combination of components which acts together to seek out a target and pass information about the target on to other devices which, in turn, utilize the information to activate various servomechanisms which correct the flight of the missile so that it will follow the target. If the seeker does not function correctly, the guidance system will not function.

Seekers which utilize three gimbals, one operating in the roll axis axis, another in the pitch axis, and another in the yaw axis are known. In the prior art, most such seekers have required that a sensor, i.e., vidicon, I R sensor, etc., be mounted on one of the gimbals. When an I R sensor or the like is mounted on a gimbal, means must be provided for refrigerant transfer through the gimbals to cool the sensor. Also, complex electrical wiring must be utilized to prevent hindrance of the motion of the gimbals. The attachment of complex cooling and electrical apparatus to the gimbals results in a seeker which is cumbersome and which can not move with the degree of freedom necessary to permit tracking of the target over a wide angle.

Prior art seekers in which the sensor is mounted off the gimbals (body fixed) have very limited motion, i.e., on the order of a 40° cone ahead of the missile, because their design has been such that after a limited amount of movement the gimbals blocked the path of the image or other incident radiation.

SUMMARY OF THE INVENTION

A seeker which directs incident radiation such as I R or visual radiation to a body mounted sensor and which allows target tracking over a very wide angle is made available by this invention. The preferred seeker according to this invention comprises three gimbals, a dual motion mirror mounted at the common meeting place of the roll, pitch and yaw axes within the gimbals and fixed mirrors to transfer incident radiation (visible or invisible) from the dual motion mirror to the sensor. The dual motion mirror moves in both the pitch and the yaw axes. It is fixed in the yaw axis and rotates in the yaw axis when the yaw gimbal rotates and the motion in the pitch plane is a one half angle motion with respect to the pitch gimbal. The dual motion serves to keep the incoming radiation directed along the yaw axis from whence it is conducted by the fixed mirrors to the body mounted sensor.

DESCRIPTION OF THE PREFERRED EMBODIMENT

Figure 1:
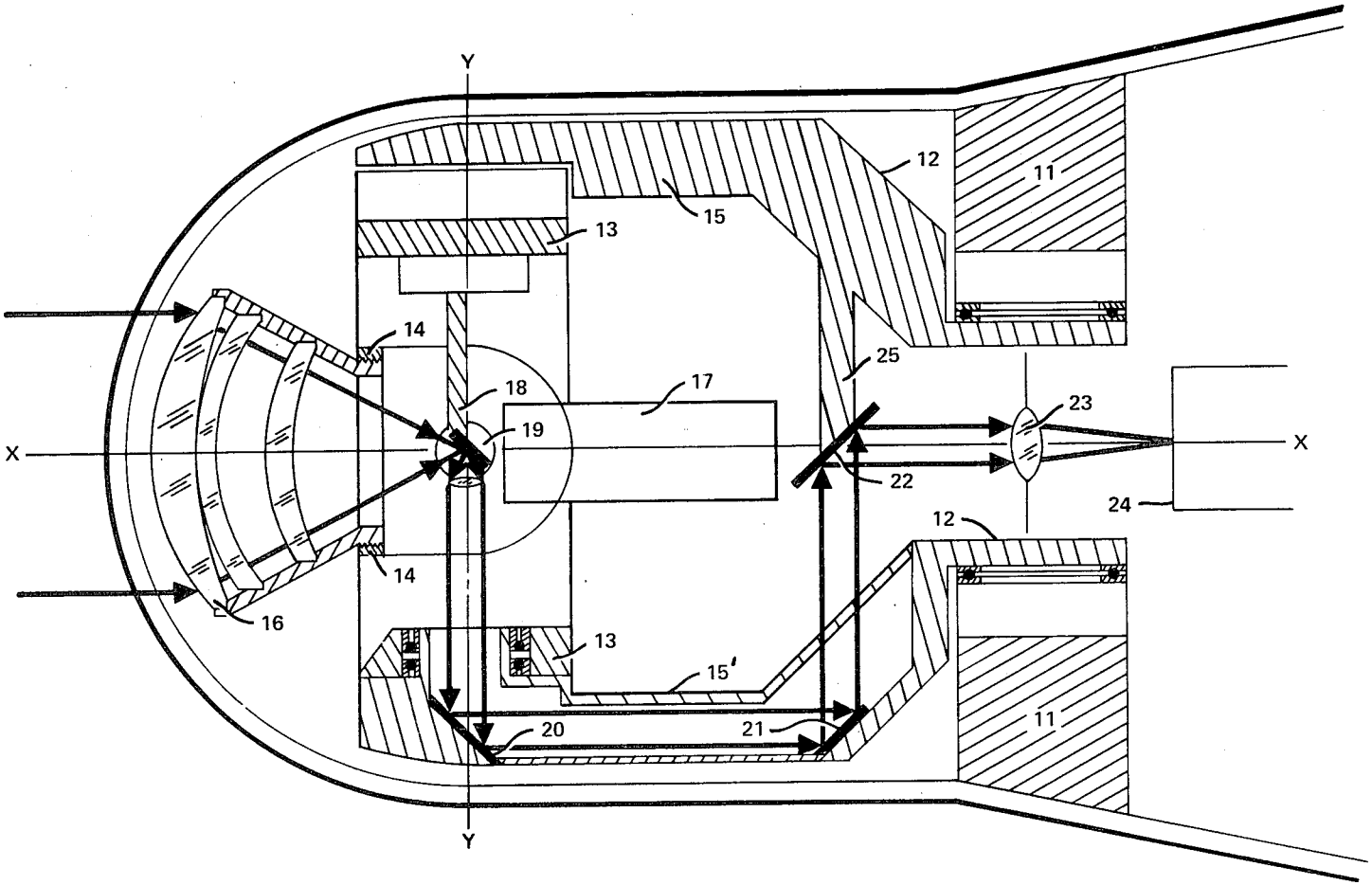
FIG. 1 is a cross sectional view of a seeker according to this invention looking along the pitch axis.

Going first to the drawing, FIG. 1 depicts a cross sectional view of a preferred seeker according to this invention. The cross section is taken of the forward part of a missile looking along the pitch axis. A base 11 is mounted within the missile and a roll gimbal 12 is rotatably mounted in a centrally located opening in the base 11. The roll gimbal is rotatable a full 360° in the roll axis of the missile.

A yaw gimbal 13 is mounted within two forward extending arms 15, 15' of the roll gimbal 12. The yaw gimbal 13 is rotatable 360° in the yaw axis. The yaw gimbal 13 is a gimbal ring having an approximately rectangular shape and a pitch gimbal 14 is mounted within the rectangular structure in a manner which permits it to rotate ± 30° in the pitch axis of the missile. The pitch gimbal serves as a support for a lens system 16 and a two axis rate gyro 17 or its equivalent.

Mounted between two inwardly extending arms 18 of the yaw gimbal is a dual motion mirror 19. The dual motion mirror 19, since it is mounted on extensions of the yaw gimbal, rotates 360° in the yaw axis when the yaw gimbal rotates as does the pitch gimbal. In addition, a system of belts and pullies or gears is utilized to cause the dual motion mirror to move one half the angle in the pitch axis that the pitch gimbal 14 does when it moves. The mounting of the mirror is such that it moves in the same direction as the pitch gimbal moves. That is, if the pitch gimbal rotates upwardly the dual motion mirror moves upwardly also, and if the pitch gimbal moves downwardly the dual motion mirror moves downwardly.

In the preferred embodiment, the dual motion of the dual motion mirror 19 insures that incident radiation reaching it through lens system 16 will always be directed along the yaw axis to a fixed mirror 20 mounted within arm 15' of the roll gimbal 12. Arm 15' is hollow in order to permit radiation striking mirror 20 to transfer onward to another fixed mirror 21 also mounted within the arm. From mirror 21, the radiation transfers out of the arm through an opening therein to fixed mirror 22 mounted on an extension 25 of the roll gimbal. From fixed mirror 22, the radiation is directed to an optics system 23 and, from thence, to sensor 24. The centrally located opening in the base in which the roll gimbal is mounted permits the radiation to pass from mirror 22 through optics system 23 to sensor 24. Potentiometers and torque motors are used in the usual way to rotate the gimbals. They are not labeled in the drawing and it should be realized that they need not necessarily be mounted in the positions depicted in the drawing.

Figure 2:
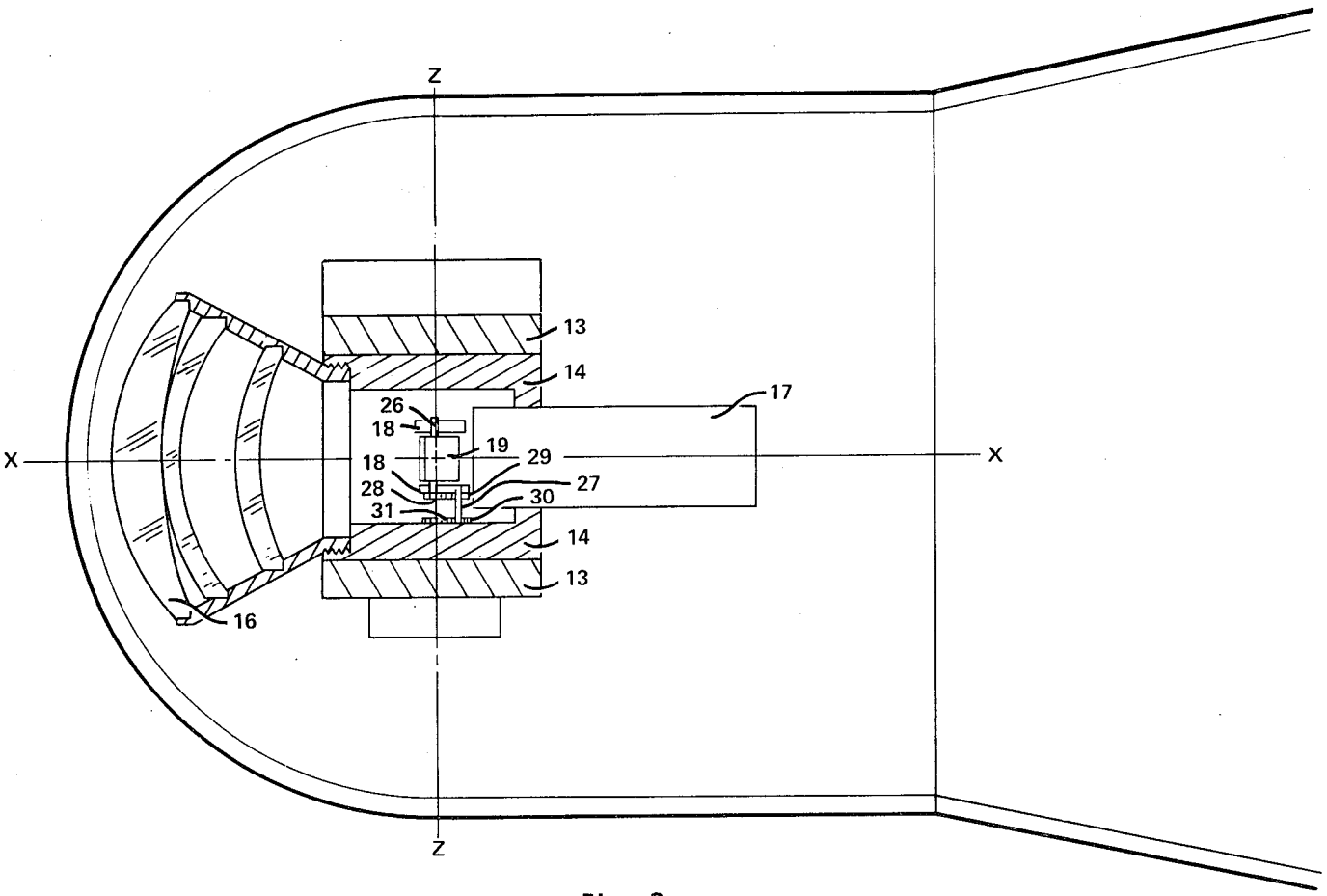
FIG. 2 is a cross sectional view of the yaw and pitch gimbals of the seeker of FIG. 1 looking along the yaw axis.

FIG. 2, which is a cross sectional view along the pitch axis of the forward end of a missile containing a preferred seeker of this invention, better depicts the half angle mirror and a system utilized to cause it to move only half the angle of the pitch gimbal. The mirror 19 is mounted on a shaft 26 which rests rotatably in arms 18 which are extensions of yaw gimbal 13. Another shaft 27 is rotatably mounted with one end in arm 18 and the other in pitch gimbal 14. One gear 28 is mounted on shaft 26. Two gears 29, 30 are mounted on shaft 27. A fourth gear 31 is mounted on another shaft (not shown) inserted into pitch gimbal 14. Gear 31 is one-half as large as gear 30 and the two of them work together. Gears 28 and 29 are of equal size and work together.

Thus, when the pitch gimbal moves and causes gear 31 to move, the interlocking action between gears 31 and 30 causes gear 30 to be rotated one half as far as gear 31. When gear 30 rotates, it turns shaft 27 and gear 29. Since gears 29 and 28 are of equal size, gear 28 rotates shaft 26 upon which mirror 19 is mounted one revolution for every revolution turned by shaft 27.

The immediately preceeding paragraph describes the dual motion mirror as being driven or moved by a system of shafts and gears. It should be recognized that a system of shafts and belt connected pullies with the proper pully sizes could be used in lieu of the gears and shafts with equal facility.

By locating half angle mirror 19 at the common meeting place of the roll, yaw and pitch axes within the gimbal system several advantages are gained. Tracking of a target within an extremely large area around the missile is made possible because radiation passing through lens system 16 will always strike the reflecting face of mirror 19 and will always be directed from thence to mirror 20. Also, placing a half angle mirror in the position indicated allows removal of the sensor from the gimbals to a position on the missile body where sufficient room is available for signal processing, protection, and necessary support equipment. By placing the sensor on the missile body, the necessity for running sensor electronics and coolant through the gimbals is removed. This allows a decrease in cost and complexity as well as a substantial increase in reliability and effective field of view, besides providing a more flexible guidance system by allowing the use of several types of sensors with a single gimbal system design.

Several alternate constructions are available with regard to the design and mechanical placement of the fixed relay mirrors. However, the placement and the motion of the dual motion mirror is restricted to that herein described. It is possible, with the correct selection of optics, to use both visible and I R sensors simultaneously thus enhancing the capability of the total tracking system. Also, the placement of a zoom lens before the sensor would allow compensation for image growth due to the closing of target-missile distance.

The concept disclosed herein is applicable to air-to-air, air-to-surface, surface-to-air, and surface-to-surface missiles. It can be utilized with point detectors as well as raster detectors.

While the above description describes apparatus for use in a missile, it should be realized that the seeker described could also be used in other devices in which seekers are ordinarily used. For example, the above-described seeker could be used in a tank turret or a periscope or the like.

What is claimed is:

1. An optical system comprising:

a platform mounted on a support for rotation about a first axis;

an objective system secured to said platform;

a mirror mounted in the optical system for rotation about said first axis;

the reflecting surface of said mirror containing said first axis; the objective system being so located that the focal point thereof lies on said reflecting surface and the first axis passing through said focal paint; and a driving connection between the mirror and the platform whereby the angular movement of the mirror is related to that of the objective system so that an incident beam received at said objective system is projected by said mirror along a second axis which is fixed in position with respect to the support.

2. An optical system according to claim 1, wherein the projected light beam is received by a camera tube.

* * * * *